US005820531A

United States Patent [19]

Choi

[11] Patent Number: 5,820,531

[45] Date of Patent: Oct. 13, 1998

[54] SAND FILLED EXERCISE STICK

[76] Inventor: Donald M. Choi, 51 W. 46th St., #4R, New York, N.Y. 10036

[21] Appl. No.: 676,940

[22] Filed: Jul. 8, 1996

[51] Int. Cl.[6] ..... A63B 21/06

[52] U.S. Cl. ..... 482/93; 482/110

[58] Field of Search ..... 482/93, 106–110, 482/148

[56] References Cited

U.S. PATENT DOCUMENTS

| | | | |
|---|---|---|---|
| D. 351,878 | 10/1994 | Globus | D21/198 |
| 2,509,810 | 5/1950 | Core | 482/108 |
| 3,006,646 | 10/1961 | Nanni | 482/109 X |
| 4,232,863 | 11/1980 | Roach . | |
| 4,538,806 | 9/1985 | Wilkerson | 482/108 |
| 4,964,630 | 10/1990 | Curtiss | 482/93 X |
| 5,056,778 | 10/1991 | Hull et al. . | |
| 5,244,445 | 9/1993 | Amesquita | 482/109 X |
| 5,328,431 | 7/1994 | Winslow | 482/106 |
| 5,364,324 | 11/1994 | Boettiger, Jr. | 482/46 |
| 5,364,325 | 11/1994 | Matthews | 482/93 X |

FOREIGN PATENT DOCUMENTS

| | | | |
|---|---|---|---|
| 855312 | 11/1960 | United Kingdom | 482/106 |

OTHER PUBLICATIONS

U.S. application No. 29/052,745 that was filed Apr. 3, 1996.

Grail McGinley, Newsday, Jun. 17, 1996 column "Fitness File" article entitled Taking a Stik to Aerobic Exercise.

*Primary Examiner*—Richard J. Apley
*Assistant Examiner*—John Mulcahy
*Attorney, Agent, or Firm*—Cobrin Gittes & Samuel

[57] ABSTRACT

A sand filled exercise stick that includes a hollow, transparent, elongated, slender, open-end, and circular-cylindrically-shaped tubular bar, pair of hollow, expandable, short, slender, open-end, and circular-cylindrically-shaped handgrips, colored sand, and a pair hollow, expandable, short, slender, and circular-cylindrically-shaped end caps. The pair of handgrips are slidably and replaceably positioned on the tubular bar. The colored sand is replaceably contained in, and viewable from, the tubular bar. The pair hollow, expandable, short, slender, and circular-cylindrically-shaped end caps replaceably sealingly receiving, and selectively opening and closing the open ends of the tubular bar and thereby maintaining the colored sand in the tubular bar.

20 Claims, 2 Drawing Sheets

SAND FILLED EXERCISE STICK

BACKGROUND OF THE INVENTION

The present invention relates to a sand filled exercise stick. More particularly, the present invention relates to a sand filled exercise stick that includes a hollow, transparent, elongated, slender, open-end, and circular-cylindrically-shaped tubular bar; a pair of hollow, expandable, short, slender, open-end, and circular-cylindrically-shaped handgrips disposed slidably and longitudinally along the hollow, transparent, elongated, slender, open-end, and circular-cylindrically-shaped tubular bar; colored sand contained in the hollow, transparent, elongated, slender, open-end, and circular-cylindrically-shaped tubular bar; and a pair hollow, expandable, short, slender, and circular-cylindrically-shaped end caps that selectively open and close the open ends of the hollow, transparent, elongated, slender, open-end, and circular-cylindrically-shaped tubular bar and maintain the colored sand therein.

Various sports including golf, tennis, and baseball require that the players have unusually strong wrist, hand, and arm muscles. Even football players, especially offensive linemen, require particularly strong hand, arm, and wrist muscles to facilitate their blocking assignments.

Moreover, a lack of conditioning of certain muscles may result in various chronic ailments which cause pain and lessen enjoyment and abilities in the pursuit of athletic activities.

For example, weakness of the lateral epicondyle of the humerus causes the common "tennis elbow" which may hinder the professional athlete in pursuit of his goals for success and which may dissuade the recreational player from enhancing his skills and furthering his enjoyment.

Another commonly recognized problem is that of "golfers elbow" which is caused by weakness of the medial epicondyle of the humerus. This condition can also hinder both the professional and recreational golfer in pursuing their respective goals.

The most common method of strengthening those muscles has been in the use of free weights which the athlete uses in wrist curl exercises. Such exercises have proven successful in merely strengthening, for example, the wrist. They are not particularly useful, however, in strengthening the entire hand, wrist, and arm sections and they also have proven detrimental to the flexibility of the joints.

Numerous innovations for arm exercising devices have been provided in the prior art that will be described. Even though these innovations may be suitable for the specific individual purposes to which they address, however, they differ from the present invention in that they do not teach a sand filled exercise stick that includes a hollow, transparent, elongated, slender, open-end, and circular-cylindrically-shaped tubular bar; a pair of hollow, expandable, short, slender, open-end, and circular-cylindrically-shaped handgrips disposed slidably and longitudinally along the hollow, transparent, elongated, slender, open-end, and circular-cylindrically-shaped tubular bar; colored sand contained in the hollow, transparent, elongated, slender, open-end, and circular-cylindrically-shaped tubular bar; and a pair hollow, expandable, short, slender, and circular-cylindrically-shaped end caps that selectively open and close the open ends of the hollow, transparent, elongated, slender, open-end, and circular-cylindrically-shaped tubular bar and maintain the colored sand therein.

FOR EXAMPLE, U.S. Pat. No. Des. 351,878 to Globus teaches an ornamental design for a physical exercise stick that includes a solid and contoured bar with rounded ends, and a pair of corresponding shaped handgrips disposed on the solid and contoured bar in proximity of the ends thereof.

ANOTHER EXAMPLE, U.S. Pat. No. 4,232,863 to Roach teaches a fitness bar for supporting a person during the performance of physical exercise that includes a base bar that is normally disposed along a horizontal surface to support one end of the fitness bar. A pair of support arms extend generally upwardly from the distal ends of the base bar, and a pair of transverse beam bars extend laterally from the upper ends of the support arms. A pair of support legs extend downwardly from the ends of the transverse beam bars for engaging the horizontal surface to support the other end of the fitness bar. The transverse beam bars are spaced apart a sufficient distance to allow a person to perform physical exercise by grasping the beam bars and moving through strenuous positions between the beam bars.

STILL ANOTHER EXAMPLE, U.S. Pat. No. 5,056,778 to Hull et al. teaches a dumbbell that is partially filled with a liquid, such as water, and has a passageway in the gripping portion thereof with a valve to control the rate of flow. When the wrist is twisted, the liquid flows from one end of the dumbbell to the other thus providing an increasing controllable resistance to the wrist and arm muscles. Also, the device may be attached to other portions of the body, such as a foot, by hook and loop fastener.

FINALLY, YET ANOTHER EXAMPLE, U.S. Pat. No. 5,364,324 to Boettiger, Jr. teaches an exercise device for use in developing and toning hand, arm, wrist, and upper body muscles. The device defines a frictional rotation exercise stick which includes a mounting bar upon which two handgrip elements are rotatably mounted. Located between these two handgrip elements is a center stop collar to prevent one of the handgrip elements from being pushed off of one end of the mounting bar when an inwardly directed force is exerted on the other handgrip element. A cylindrical weight is screw threaded onto each end of the mounting bar. End stop collars are disposed between these weights and the handgrip elements. Compression bias and friction elements are provided between the end stop collars and the handgrip elements to provide an increase in rotational resistance of the handgrip elements in response to a tightening of the cylindrical weights against the stop collars while retaining a smoothness of operation. The relationship between the handgrip elements, the compression bias means, the end stop collars, the center stop collar, and the mounting bar reduces the tendency for rotation of the handgrip elements to be transferred to the cylindrical weights thus preventing a backing off of the compression bias applied. In addition, this structure provides an exercise device which features variable tension resistance and smoothness of operation which promotes efficient exercise.

It is apparent that numerous innovations for arm exercising devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a sand filled exercise stick that avoids the disadvantages of the prior art.

ANOTHER OBJECT of the present invention is to provide a sand filled exercise stick that is simple and inexpensive to manufacture.

STILL ANOTHER OBJECT of the present invention is to provide a sand filled exercise stick that is simple to use.

YET ANOTHER OBJECT of the present invention is to provide a sand filled exercise stick that is an innovative workout tool that provides a creative new dimension to low impact aerobics and complete body toning.

STILL YET ANOTHER OBJECT of the present invention is to provide a sand filled exercise stick that effectively increases a user's heart rate.

YET STILL ANOTHER OBJECT of the present invention is to provide a sand filled exercise stick that provides control over movement and thereby reduces risk of injury during use thereof.

STILL YET ANOTHER OBJECT of the present invention is to provide a sand filled exercise stick that is the ultimate fitness tool to help a user maintain balance, improve technique, and complement a variety of aerobic and conditioning routines.

YET STILL ANOTHER OBJECT of the present invention is to provide a sand filled exercise stick that is durable.

BRIEFLY STATED, STILL YET ANOTHER OBJECT of the present invention is to provide a sand filled exercise stick that has a weight and includes a hollow, transparent, elongated, slender, open-end, and circular-cylindrically-shaped tubular bar, pair of hollow, expandable, short, slender, open-end, and circular-cylindrically-shaped handgrips, colored sand, and a pair hollow, expandable, short, slender, and circular-cylindrically-shaped end.

YET STILL ANOTHER OBJECT of the present invention is to provide a sand filled exercise stick wherein the hollow, transparent, elongated, slender, open-end, and circular-cylindrically-shaped tubular bar has open ends.

STILL YET ANOTHER OBJECT of the present invention is to provide a sand filled exercise stick wherein each handgrip of the pair of hollow, expandable, short, slender, open-end, and circular-cylindrically-shaped handgrips has open ends.

YET STILL ANOTHER OBJECT of the present invention is to provide a sand filled exercise stick wherein the pair of hollow, expandable, short, slender, open-end, and circular-cylindrically-shaped handgrips are longitudinally slidable and replaceably positioned, via the open ends thereof, on the hollow, transparent, elongated, slender, open-end, and circular-cylindrically-shaped tubular bar, so that slippage when the sand filled exercise stick is being handled and while being gripped during exercising therewith is prevented, and the slidabilty of the pair of hollow, expandable, short, slender, open-end, and circular-cylindrically-shaped handgrips on the hollow, transparent, elongated, slender, open-end, and circular-cylindrically-shaped tubular bar allows the pair of hollow, expandable, short, slender, open-end, and circular-cylindrically-shaped handgrips to be comfortably positioned along the hollow, transparent, elongated, slender, open-end, and circular-cylindrically-shaped tubular bar to accommodate for different exercisers, and the replaceabilty of the pair of hollow, expandable, short, slender, open-end, and circular-cylindrically-shaped handgrips allows for cleaning of sweat adsorbed thereon from sweaty palms during exercising therewith.

STILL YET ANOTHER OBJECT of the present invention is to provide a sand filled exercise stick wherein the colored sand has a weight and an amount and is replaceably contained in, and viewable from, the hollow, transparent, elongated, slender, open-end, and circular-cylindrically-shaped tubular bar, so that additional weight is provided to produce a harder workout while an appealing aesthetic appearance is achieved that increases motivation to exercise with the sand filled exercise stick.

YET STILL ANOTHER OBJECT of the present invention is to provide a sand filled exercise stick wherein each end cap of the pair hollow, expandable, short, slender, and circular-cylindrically-shaped end caps has an open end replaceably sealingly receiving, and selectively opening and closing, an open end of the open ends of the hollow, transparent, elongated, slender, open-end, and circular-cylindrically-shaped tubular bar and thereby maintaining the colored sand in the hollow, transparent, elongated, slender, open-end, and circular-cylindrically-shaped tubular bar, so that slippage of the sand filled exercise stick on wooden floors is prevented when using the sand filled exercise stick for balance and the removabilty of the pair of hollow, expandable, short, slender, and circular-cylindrically-shaped end caps from the hollow, transparent, elongated, slender, open-end, and circular-cylindrically-shaped tubular bar allows the colored sand to be selectively poured into and removed from, the hollow, transparent, elongated, slender, open-end, and circular-cylindrically-shaped tubular bar.

STILL YET ANOTHER OBJECT of the present invention is to provide a sand filled exercise stick wherein the hollow, transparent, elongated, slender, open-end, and circular-cylindrically-shaped tubular bar is a clear crack resistant plastic selected from the group consisting of butyrate, polycarbonate, and polyvinylchloride.

YET STILL ANOTHER OBJECT of the present invention is to provide a sand filled exercise stick wherein the hollow, transparent, elongated, slender, open-end, and circular-cylindrically-shaped tubular bar is 42" in length, has an outer diameter 1.25", a wall thickness of 0.125", an inner diameter of 1.0", and weighs 1.3 lbs, so that a clean cosmetic looking aesthetic appearance thereof is provided, while providing control and balance for an exerciser exercising therewith.

STILL YET ANOTHER OBJECT of the present invention is to provide a sand filled exercise stick wherein the pair of hollow, expandable, short, slender, open-end, and circular-cylindrically-shaped handgrips are shorter than the hollow, transparent, elongated, slender, open-end, and circular-cylindrically-shaped tubular bar.

YET STILL ANOTHER OBJECT of the present invention is to provide a sand filled exercise stick wherein each handgrip of the pair of hollow, expandable, short, slender, open-end, and circular-cylindrically-shaped handgrips is a black foam material, is 7" in length, has an outer diameter of 1.25", a negligible weight, a wall thickness of 0.125", and an inner diameter of 1.125 that expands to 1.5" when positioned on the hollow, transparent, elongated, slender, open-end, and circular-cylindrically-shaped tubular bar.

STILL YET ANOTHER OBJECT of the present invention is to provide a sand filled exercise stick wherein the colored sand is selected from the group consisting of 1 of 10 different colors and combination of at least 2 of 10 different colors, so that a personalized pattern is formed that further increases motivation to exercise with the sand filled exercise stick.

YET STILL ANOTHER OBJECT of the present invention is to provide a sand filled exercise stick wherein the weight of the colored sand can be varied by the amount of the colored sand contained in the hollow, transparent, elongated, slender, open-end, and circular-cylindrically-shaped tubular bar, so that the weight of the sand filled exercise stick can be varied.

STILL YET ANOTHER OBJECT of the present invention is to provide a sand filled exercise stick wherein each end cap of the pair of hollow, expandable, short, slender, and circular-cylindrically-shaped end caps is black rubber, is 1.5" in length, has an outer diameter of 1.375", a wall thickness of 0.0625", a negligible weight, and an inner diameter of 1.25" that expands when positioned on an open end of the open ends of the hollow, transparent, elongated, slender, open-end, and circular-cylindrically-shaped tubular bar, so that a secure fit is formed therewith.

YET STILL ANOTHER OBJECT of the present invention is to provide a sand filled exercise stick wherein the pair of hollow, expandable, short, slender, and circular-cylindrically-shaped end caps is glued to the hollow, transparent, elongated, slender, open-end, and circular-cylindrically-shaped tube after the colored sand has been contained in the hollow, transparent, elongated, slender, open-end, and circular-cylindrically-shaped tubular bar.

FINALLY, STILL YET ANOTHER OBJECT of the present invention is to provide a method of preparing a sand filled exercise stick for use that has a weight and includes the steps of sliding a pair of hollow, expandable, short, slender, open-end, and circular-cylindrically-shaped handgrips of the sand filled exercise stick, via open ends thereof, onto a hollow, transparent, elongated, slender, open-end, and circular-cylindrically-shaped tubular bar of the sand filled exercise stick; sliding the pair of hollow, expandable, short, slender, open-end, and circular-cylindrically-shaped handgrips, along the hollow, transparent, elongated, slender, open-end, and circular-cylindrically-shaped tubular bar to a position that is comfortable for an exerciser using the sand filled exercise stick; engaging an open end of one end cap of a pair of hollow, expandable, short, slender, and circular-cylindrically-shaped end caps of the sand filled exercise stick with, and sealing closing, one open end of open ends of the hollow, transparent, elongated, slender, open-end, and circular-cylindrically-shaped tube; pouring colored sand of at least one color, having a weight and an amount, through another open end of the open ends of the hollow, transparent, elongated, slender, open-end, and circular-cylindrically-shaped tube; and engaging an open end of another end cap of the pair of hollow, expandable, short, slender, and circular-cylindrically-shaped end caps with, and sealing closing, the another open end of the open ends of the hollow, transparent, elongated, slender, open-end, and circular-cylindrically-shaped tube.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
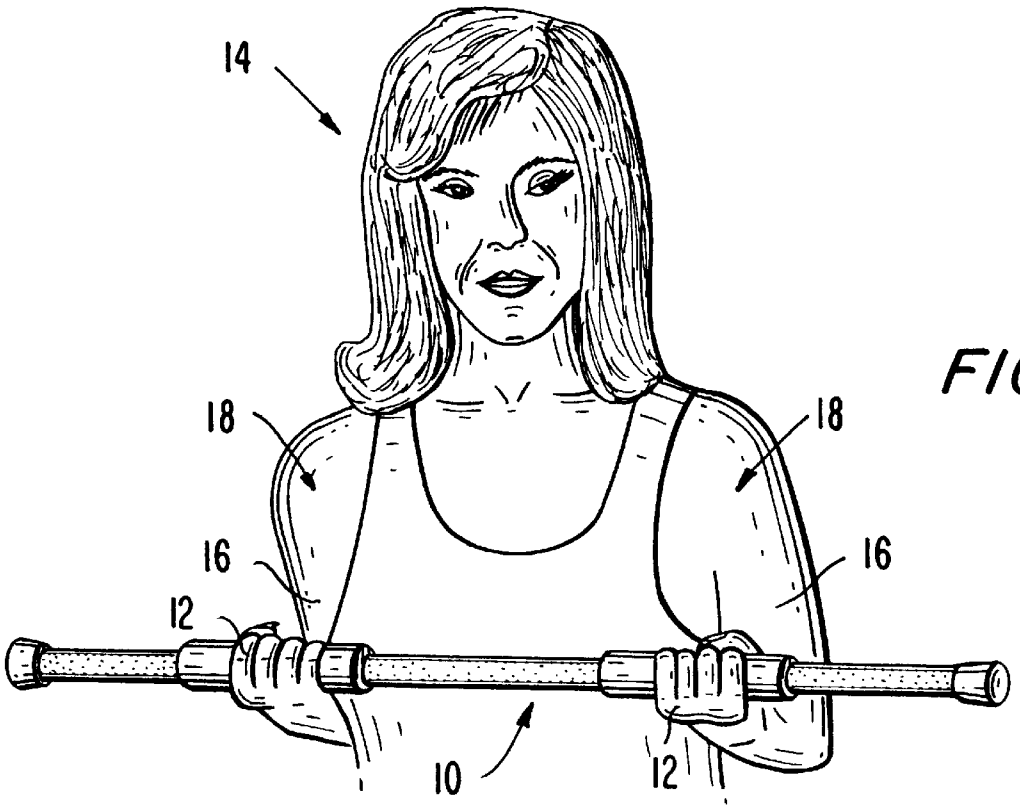
FIG. 1 is a diagrammatic perspective view of the present invention being held by a user while performing curls therewith.

10 sand filled exercise stick of the present invention
12 exerciser hands
14 exerciser
16 exerciser arm biceps
18 exerciser arms
20 hollow, transparent, elongated, slender, open-end, and circular-cylindrically-shaped tubular bar
22 tubular bar open ends
24 pair of hollow, expandable, short, slender, open-end, and circular-cylindrically-shaped handgrips
26 handgrip open ends
28 colored sand
30 pair hollow, expandable, short, slender, and circular-cylindrically-shaped end caps
32 end cap open end

DETAILED DESCRIPTION OF THE PREFERRED EMBODIMENT

Referring now to the figures in which like numerals indicate like parts, and particularly to FIG. 1, which is a diagrammatic perspective view of the present invention being held by a user while performing curls therewith, the sand filled exercise stick of the present invention is shown generally at 10 being held in exerciser hands 12 of an exerciser 14 while the exerciser 14 is performing curls to exercise exerciser arm biceps 16 of exerciser arms 18 of the exerciser 14.

It is to be understood, however, that the use of the sand filled exercise stick 10 during curl exercises is for illustrative purposes only, and that the sand filled exercise stick 10 can be used during any exercise deemed appropriate by the exerciser 14.

The configuration of the sand filled exercise stick 10 can best be seen in FIGS. 2–4, which are an enlarged diagrammatic elevational view of the present invention containing sand of one color, an enlarged diagrammatic elevational view of the present invention containing sand of more than one color so as to form a personalized pattern therewith, and an enlarged and exploded diagrammatic perspective view of the present invention, respectively, and as such will be discussed with reference thereto.

The sand filled exercise stick 10 includes a hollow, transparent, elongated, slender, open-end, and circular-cylindrically-shaped tubular bar 20 that has tubular bar open ends 22.

The hollow, transparent, elongated, slender, open-end, and circular-cylindrically-shaped tubular bar 20 is a clear crack resistant plastic preferably butyrate, polycarbonate, or polyvinylchloride.

The hollow, transparent, elongated, slender, open-end, and circular-cylindrically-shaped tubular bar 20 is preferably: 42" in length, has an outer diameter of 1.25", a wall thickness of 0.125", an inner diameter of 1.0", and weighs 1.3 lbs.

The shape, material, and dimensions of the hollow, transparent, elongated, slender, open-end, and circular-cylindrically-shaped tubular bar 20 discussed, supra, are of critical importance, ipso facto, they provide a clean cosmetic looking aesthetic appearance thereof, while providing control and balance for the exerciser 14 exercising therewith.

The sand filled exercise stick 10 further includes a pair of hollow, expandable, short, slender, open-end, and circular-cylindrically-shaped handgrips 24 that have handgrip open ends 26.

The pair of hollow, expandable, short, slender, open-end, and circular-cylindrically-shaped handgrips 24 are slidably and replaceably positioned, via the handgrip open ends 26 thereof, onto the hollow, transparent, elongated, slender, open-end, and circular-cylindrically-shaped tubular bar 20, and are shorter than the hollow, transparent, elongated, slender, open-end, and circular-cylindrically-shaped tubular bar 20.

The pair of hollow, expandable, short, slender, open-end, and circular-cylindrically-shaped handgrips 24 prevent slippage when the sand filled exercise stick 10 is being handled or while being gripped during low/high impact aerobics therewith.

The slidability of the pair of hollow, expandable, short, slender, open-end, and circular-cylindrically-shaped handgrips 24 on the hollow, transparent, elongated, slender, open-end, and circular-cylindrically-shaped tubular bar 20 allows the pair of hollow, expandable, short, slender, open-end, and circular-cylindrically-shaped handgrips 24 to be comfortably positioned along the hollow, transparent, elongated, slender, open-end, and circular-cylindrically-shaped tubular bar 20 to accommodate for different exercisers 14.

The replaceabilty of the pair of hollow, expandable, short, slender, open-end, and circular-cylindrically-shaped handgrips 24 allows for cleaning of sweat adsorbed thereon from sweaty palms during exercising therewith.

Each handgrip of the pair of hollow, expandable, short, slender, open-end, and circular-cylindrically-shaped handgrips 24 is preferably: a black foam material, is 7" in length, has an outer diameter of 1.25", a wall thickness of 0.125", an inner diameter of 1.125" that expands to 1.5" when positioned on the hollow, transparent, elongated, slender, open-end, and circular-cylindrically-shaped tubular bar 20, and has a negligible weight.

The shape, material, and dimensions of each handgrip of the pair of hollow, expandable, short, slender, open-end, and circular-cylindrically-shaped handgrips 24 discussed, supra, are of critical importance, ipso facto, they allow for easy gripping by the exerciser 14.

The sand filled exercise stick 10 further includes colored sand 28 that is replaceably contained in, is viewed from, and fills, the hollow, transparent, elongated, slender, open-end, and circular-cylindrically-shaped tubular bar 20.

The colored sand 28 preferably provides an additional weight of 1.6 lbs. yielding an overall weight for the sand filled exercise stick 10 of 2.9 lbs, so that the exerciser 14 is given added resistance for a harder workout.

Figure 2:
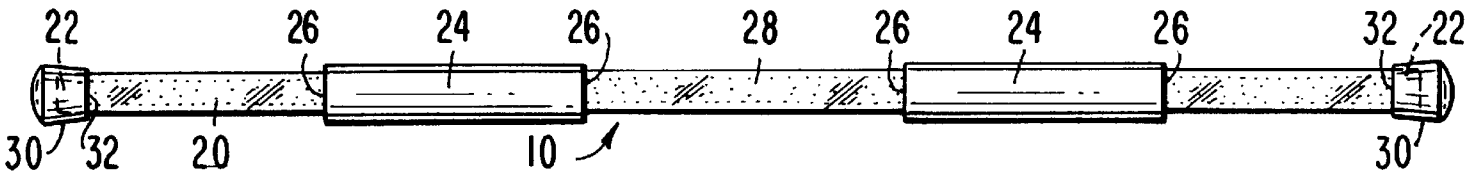
FIG. 2 is an enlarged diagrammatic elevational view of the present invention containing sand of one color.
Figure 3:
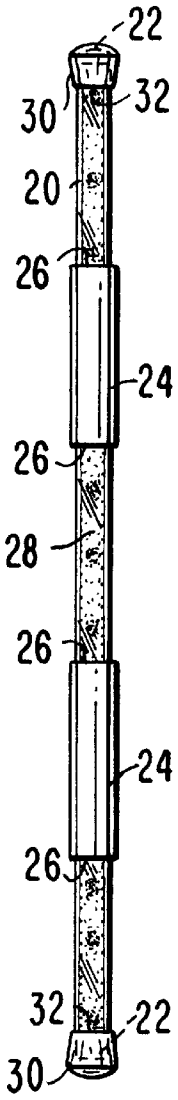
FIG. 3 is an enlarged diagrammatic elevational view of the present invention containing sand of more than one color so as to form a personalized pattern therewith.
Figure 4:
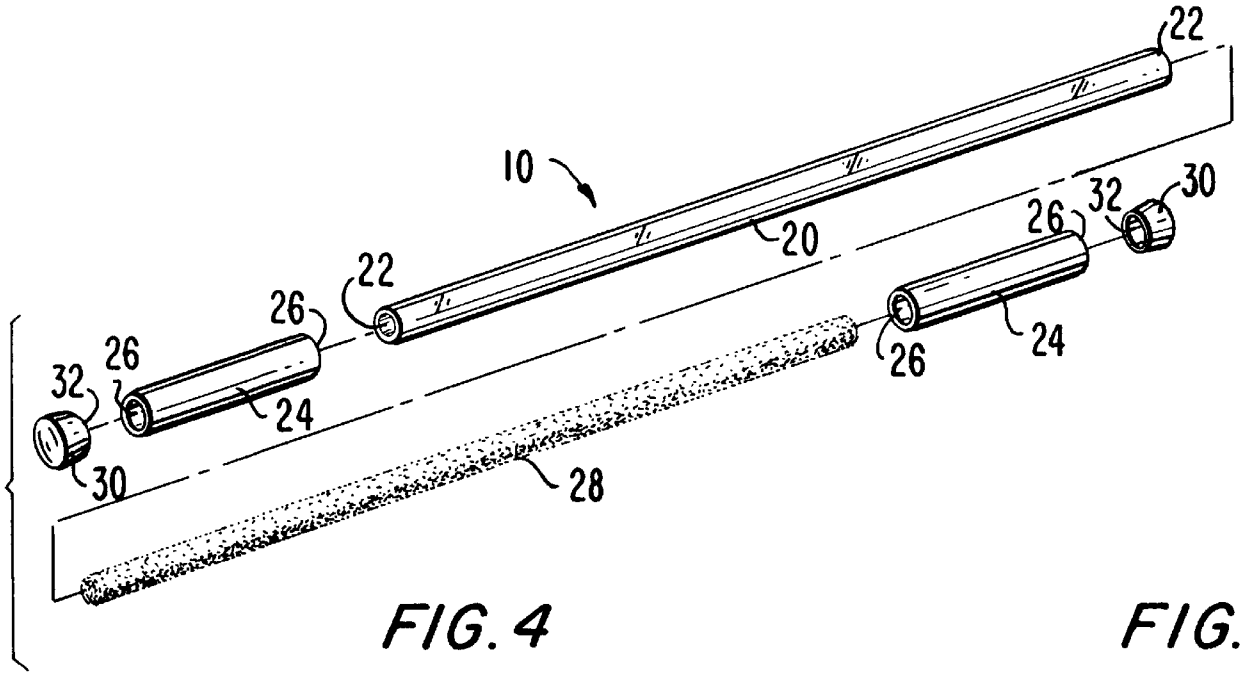
FIG. 4 is an enlarged and exploded diagrammatic perspective view of the present invention.

The colored sand 28 provides an appealing aesthetic appearance to increase motivation to exercise with the sand filled exercise stick 10, and can be any 1 of 10 different colors as shown in FIG. 2, or can be any combination of at least 2 of the 10 colors so as to form a personalized pattern as shown in FIG. 3.

The sand filled exercise stick 10 further includes a pair hollow, expandable, short, slender, and circular-cylindrically-shaped end caps 30. Each end cap of the pair hollow, expandable, short, slender, and circular-cylindrically-shaped end caps 30 has an end cap open end 32 that replaceably sealingly engages, and selectively opens and closes, one open end of the tubular bar open ends 22 of the hollow, transparent, elongated, slender, open-end, and circular-cylindrically-shaped tubular bar 20 and thereby maintains the colored sand 28 in the hollow, transparent, elongated, slender, open-end, and circular-cylindrically-shaped tubular bar 20.

The removabilty of either end cap of the pair of hollow, expandable, short, slender, and circular-cylindrically-shaped end caps 30 from the hollow, transparent, elongated, slender, open-end, and circular-cylindrically-shaped tubular bar 20 allows the colored sand 28 to be poured into, or removed from, the hollow, transparent, elongated, slender, open-end, and circular-cylindrically-shaped tubular bar 20.

The pair of hollow, expandable, short, slender, and circular-cylindrically-shaped end caps 30 prevent slippage of the sand filled exercise stick 10 on wooden floors when using the sand filled exercise stick 10 for balance with a frictional surface of an end of one of the end caps 10 resting on the wooden floor.

Each end cap of the pair of hollow, expandable, short, slender, and circular-cylindrically-shaped end caps 30 is preferably: black rubber, is 1.5" in length, has an outer diameter of 1.375", a wall thickness of 0.0625", an inner diameter of 1.25" that expands when positioned on the tubular bar open ends 22 of the hollow, transparent, elongated, slender, open-end, and circular-cylindrically-shaped tubular bar 20 so as to form a secure fit therewith, and has a negligible weight.

It is to be understood that the pair of hollow, expandable, short, slender, and circular-cylindrically-shaped end caps 30 may be glued or epoxied to the hollow, transparent, elongated, slender, open-end, and circular-cylindrically-shaped tubular bar 20, if so desired.

The shape, material and dimensions of each end cap of the pair of hollow, expandable, short, slender, and circular-cylindrically-shaped end caps 30 discussed, supra, are of critical importance, ipso facto, they allow for secure engagement with the hollow, transparent, elongated, slender, open-end, and circular-cylindrically-shaped tubular bar 20.

The manner of preparing the sand filled exercise stick 10 will be discussed, infra.

STEP 1: Slide the pair of hollow, expandable, short, slender, open-end, and circular-cylindrically-shaped handgrips, via the handgrip open ends 26 thereof, onto the hollow, transparent, elongated, slender, open-end, and circular-cylindrically-shaped tubular bar.

STEP 2: Slide the pair of hollow, expandable, short, slender, open-end, and circular-cylindrically-shaped handgrips, along the hollow, transparent, elongated, slender, open-end, and circular-cylindrically-shaped tubular bar to a position that is comfortable for the exerciser 14.

STEP 3: Engage the end cap open end 32 of one end cap of the pair of hollow, expandable, short, slender, and circular-cylindrically-shaped end caps 30 with, and sealing closing, one open end of the tubular bar open ends 22 of the hollow, transparent, elongated, slender, open-end, and circular-cylindrically-shaped tubular bar 20.

STEP 4: Pour colored sand 28 of at least one color through the other open end of the tubular bar open ends 22 of the hollow, transparent, elongated, slender, open-end, and circular-cylindrically-shaped tubular bar 20.

STEP 5: Engage the end cap open end 32 of the other end cap of the pair of hollow, expandable, short, slender, and circular-cylindrically-shaped end caps 30 with, and sealing closing, the other open end of the tubular bar open ends 22 of the hollow, transparent, elongated, slender, open-end, and circular-cylindrically-shaped tubular bar 20.

It will be understood that each of the elements described above, or two or more together, may also find a useful application in other types of constructions differing from the types described above.

While the invention has been illustrated and described as embodied in a sand filled exercise stick, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sand filled exercise stick, comprising:

a) a tubular bar that is transparent and has open ends;

b) a pair of tubular handgrips that have open ends, said handgrips being in an expanded condition on and concentric with said tubular bar and imparting a resilient grasping force on said tubular bar to prevent slippage as said hand grips are being handled and being gripped during exercising therewith, said handgrips being longitudinally slidable to desired locations on said tubular bar;

c) sand filling and contained within said tubular bar and visible through the tubular bar because the tubular bar is transparent; and d) a pair of end caps each closing a respective one of said open ends of said tubular bar to seal in said sand within said tubular bar, said end caps each providing an exteriorly facing frictional surface capable, while resting on a wooden floor, of preventing slippage of said sand filled exercise stick as said sand filled exercise stick is used for balance on the wooden floor during exercising.

2. The stick as defined in claim 1, wherein said end caps are removable from said tubular bar to allow said sand to be poured into and removed from said tubular bar.

3. The stick as defined in claim 1, wherein said tubular bar is of a clear crack resistant plastic selected from the group consisting of butyrate, polycarbonate, and polyvinylchloride.

4. The stick as defined in claim 1, wherein said tubular bar is 43" in length, has an outer diameter of 1.25", a wall thickness of 0.125", and inner diameter of 1.0", and weighs 1.3 lbs.

5. The stick as defined in claim 1, wherein said pair of handgrips are each shorter than said tubular bar.

6. The stick as defined in claim 1, wherein each of said handgrips is a foam material, is 7" in length, has an outer diameter of 1.25", a wall thickness of 0.125", and an inner diameter of 1.125" that expands to 1.5" when positioned on said tubular bar.

7. The stick as defined in claim 1, wherein said sand is selected from the group consisting of sands each of a different color and a combination of sands each of a different color.

8. The stick as defined in claim 1, wherein each of said end caps is rubber, is 1.5" in length, has an outer diameter of 1.375", a wall thickness of 0.0625", and an inner diameter of 1.25" that expands when positioned on a respective one of said open ends of said tubular bar to form a secure fit.

9. The stick as defined in claim 1, wherein said pair of end caps are each glued to said tubular bar to seal in said sand within said tubular bar.

10. The stick as defined in claim 1, wherein said end caps are each in an expanded condition that imparts a resilient grasping force on said tubular bar at locations neighboring said open ends of said tubular bar.

11. The stick as defined in claim 1, wherein the sand is colored.

12. A method of preparing a sand filled exercise stick, comprising the steps of:

a) expanding and then sliding a pair of tubular handgrips onto a tubular bar to desired positions along said tubular bar so that said handgrips are concentric with said tubular bar, the tubular bar being transparent and having two open ends;

b) closing a first of said two open ends of said tubular bar with an end cap to seal the first of said two open ends;

c) pouring sand through the second of the two open ends of said tubular bar until filling with said sand; and d) closing the second open end of the tubular bar with a further end cap to seal the second of said two open ends.

13. The method as defined in claim 12, wherein said tubular bar is a clear crack resistant plastic selected from the group consisting of butyrate, polycarbonate, and polyvinylchloride.

14. The method as defined in claim 12, wherein said tubular bar is 42" in length, has an outer diameter of 1.25", a wall thickness of 0.125", an inner diameter of 1.0", and weighs 1.3 lbs.

15. The method as defined in claim 12, wherein said paid of handgrips are shorter than said tubular bar.

16. The method as defined in claim 12, wherein each of said handgrips is a foam material, is 7" in length, has an outer diameter of 1.25", a wall thickness of 0.125", and an inner diameter of 1.125" that expands to 1.5" when positioned on said tubular bar.

17. The method as defined in claim 12, wherein said sand is selected from the group consisting of sands each of a different color and a combination of sands each of a different color.

18. The method as defined in claim 12, wherein each of said end caps is rubber, is 1.5" in length, has an outer diameter of 1.375", a wall thickness of 0.0625", a negligible weight, and an inner diameter of 1.25" that expands when positioned on a respective one of said open ends of said tubular bar so that a secured fit is formed therewith.

19. The method as defined in claim 12, wherein step (b) includes expanding the first-mentioned end cap to fit onto the first of said two open ends and impart a resilient grasping force onto the tubular bar at a location neighboring the first of said two open ends to effect the seal of the first of said two open ends, step (d) including expanding the further end cap to fit onto the second of said two open ends and impart a further resilient grasping force onto the tubular bar at a location neighboring the second of said two open ends to effect the seal of the second of said two open ends.

20. The method as defined in claim 12, wherein the sand is colored.

* * * * *